United States Patent [19]

Takashima

[11] 3,981,721

[45] Sept. 21, 1976

[54] METHOD FOR DESULFURIZING MOLTEN IRON

[75] Inventor: Masaru Takashima, Komae, Japan

[73] Assignee: Aikoh Co., Ltd., Tokyo, Japan

[22] Filed: Feb. 27, 1975

[21] Appl. No.: 553,709

[30] Foreign Application Priority Data

Feb. 27, 1974 Japan ..... 49-22341
Apr. 9, 1974 Japan ..... 49-39499

[52] U.S. Cl. ..... 75/58; 75/25; 75/53

[51] Int. Cl.[2] ..... C21C 7/02

[58] Field of Search ..... 75/25, 58, 53

[56] References Cited

UNITED STATES PATENTS

| | | | |
|---|---|---|---|
| 2,277,663 | 3/1942 | Francis | 75/25 |
| 2,861,881 | 11/1958 | Phelps | 75/25 |
| 3,537,842 | 11/1970 | Holland | 75/58 |
| 3,748,121 | 7/1973 | Atterbury | 75/53 |

*Primary Examiner*—Peter D. Rosenberg
*Attorney, Agent, or Firm*—Sughrue, Rothwell, Mion, Zinn and Macpeak

[57] ABSTRACT

In a method for desulfurizing molten iron, which comprises adding a desulfurizing agent to the molten iron, the improvement which comprises the desulfurizing agent being a dust collected from the smelting step of manganese and/or a dust collected from the smelting step of chromium.

10 Claims, No Drawings

METHOD FOR DESULFURIZING MOLTEN IRON

BACKGROUND OF THE INVENTION

1. Field of the Invention

This invention relates to a method for desulfurizing molten iron using the dust collected at the time of smelting manganese or chromium which has previously been discarded as a waste, but the components of which have been found effective for desulfurization of molten iron.

2. Description of the Prior Art

Heretofore, alkali metal compounds such as soda ash or sodium hydroxide, and alkaline earth metals such as magnesium or their compounds such as calcium cyanamide or calcium carbide have been used as desulfurizing agents for molten iron. Methods for using these desulfurizing agents include, for example, a method in which the desulfurizing agent is placed beforehand in a ladle, and then molten iron is poured into the ladle, a method in which a shaking ladle is used in order to promote mixing a method in which an impeller is used for stirring, or an injection method in which the desulfurizing agent is blown into the molten iron together with an inert gas.

Because of its low cost and the simplicity of its use, soda ash has been regarded as the most feasible desulfurizing agent and has in fact been used in the largest amount, but since the desulfurizing effect of soda ash varies soda ash exhibits only a weak action in desulfurization when molten iron having a relatively low sulfur content is poured into a ladle.

SUMMARY OF THE INVENTION

According to this invention, the effective components to be described hereinbelow of the dust collected at the time of smelting manganese or chromium, which add nothing to the cost of production, are used as a desulfurizing agent for molten iron. The method of this invention for desulfurizing molten iron comprises adding the dust collected in the smelting of manganese or chromium to the molten iron.

DETAILED DESCRIPTION OF THE INVENTION

The collected dust from smelting, manganese or chromium can be used either alone or in admixture with commercially available soda ash containing sodium carbonate as a pure component for supplementing the alkali content. Or, conversely, the collected dust having a relatively low alkali content is blended as an auxiliary desulfurizing agent with soda ash so as to stabilize the desulfurizing activity of the soda ash, and to render the molten iron slag flowable. When it is necessary to prevent the scattering of the desulfurizing agent, for example, in the preplaced method, the dust is used as a solid desulfurizing agent which further contains a cement containing CaO as the predominant component and water capable of hardening the cement also.

The above cement can be, for example, Portland cement and contains CaO as the predominant component. Not only does the cement act as a binder, but also the action of CaO causes the $Na_2S$ formed by desulfurization to be converted to CaS and thus results in a stabilization and promotes the prevention of sulfur restoration. The cement hardens under the action of water added at the same time. A suitable amount of the cement is about 2 to 25% by weight. If the amount of the cement is less than about 2% by weight the cement has a weak action as a binder, and is not effective. On the other hand, if the amount of the cement exceeds about 25% by weight the cement impedes the flowability of the slag and causes the contact between the desulfurizing agent and the molten iron to be poor, which in turn results in a reduction in the effect of desulfurization.

The water added simultaneously with the cement acts to harden the cement. Furthermore, steam is generated as a result of the heating of the water due to the heat of the molten iron at the time of desulfurization, and decomposes into hydrogen and oxygen upon contact with the molten iron. By an explosive reaction of these gases, the molten iron is abruptly stirred, and consequently, the contact between the desulfurizing agent and the molten iron is promoted. Thus, the effect of the desulfurizing agent is increased. A suitable amount of water is about 3 to 30% by weight. If the amount of water is less than about 3% by weight, the steam evaporates almost completely in the ladle before the pouring of molten iron, and no agitation results. On the other hand, if the amount of the water exceeds about 30% by weight, water acts more vigorously than simply to agitate the molten iron, and the danger of an explosion and scattering can occur. Accordingly, amounts outside the above specified range are not suitable.

The collected dust described above is obtained by collecting the sublimed product and the scattered dust or smoke particles, etc. generated from the furnace during the manufacture of metallic manganese, ferromanganese, siliconmanganese, or ferrochromium, etc. by the dry smelting of an ore or slag of manganese or chromium using a dust collector which precipitates, absorbs and accumulates such a dust. The dust results from the freeing and subliming of a part of the alkalies ($K_2O$, $Na_2O$) in the crude ore due to a heating and a precipitation of these in the flue, dust collector, etc. in a condensed form. Therefore, the dust comprises the alkalies ($K_2O$, $Na_2O$) and CaO, $SiO_2$, $Al_2O_3$, C, $Fe_2O_3$ and MnO or a small amount of $Cr_2O_3$ as a result of the physical scattering of fine particles of the crude ore, the additives, etc. Specifically, a manganese dust, for example, contains, by weight, about 2 to 20% of $Na_2O$, about 5 to 50% of $K_2O$, about 20 to 40% of MnO, about 5 to 30% of CaO, about 3 to 20% of $SiO_2$, about 3 to 10% of C, and not more than about 5% of each of $Al_2O_3$, $Fe_2O_3$, and $CaF_2$. Chromium dust contains by weight, about 3 to 25% of $Na_2O$, about 4 to 40% of $K_2O$, about 4 to 15% of CaO, about 5 to 30% of $SiO_2$, not more than about 5% of $Cr_2O_3$, and not more than about 5% of each of C, $Al_2O_3$, $Fe_2O_3$ and $CaF_2$. since both of these dusts form low-melting slags having a melting point of less than about 1000°C. and containing alkalines, they are effective for desulfurizing molten iron. When the alkali content is low, components such as CaO, MnO, $SiO_2$, $Fe_2O_3$, $Al_2O_3$ and $CaF_2$ form a slag having good flowability as a slag-melting agent for stabilizing the desulfurizing ability of soda ash, and thus have an effect of promoting the contact between the desulfurized slag and the molten iron. If the components of the dust are basic, the dust can be theoretically used alone as a desulfurizing agent. However, preferably, the dust has a $$\frac{Na_2O(\%) + K_2O(\%)}{SiO_2(\%) + Al_2O_3(\%)}$$

value of at least about 2.0. If this value is below about 2.0, the dust preferably is used in admixture with soda ash.

A suitable mixing ratio of the collected dust to the soda ash is about 5 to 99% for the collected dust and about 95% to 1% for the soda ash. If the amount of soda ash is less than about 1%, the soda ash does not effectively supplement the alkali content, and when the collected dust is added to soda ash in amounts of less than about 5% (of the dust) a poor effect of rendering the slag flowable results. The lower limits of the proportions of these are also the same when the desulfurizing agent is employed in a granulated form, i.e., with the cement hereinbefore defined. In view of the fact that the proportions of cement and water for granulation are about 2 to 25% and about 3 to 30%, respectively, the proportion of the collected dust at the time of granulating the collected dust alone is about 45 to 95%, and when the collected dust is mixed with soda ash, the amount of the collected dust is about 5 to 94% and the amount of the soda ash is about 90 to 1%.

The desulfurizing agent used in the desulfurizing method of this invention can be used in any of the preplaced method, the agitation method, and the blowing method. However, better results can be obtained by using a powdery dust with the blowing method or agitation method, and a granulated dust, using the preplaced method.

The desulfurizing agent used in the desulfurizing method of this invention may further contain a bulking agent such as scale, red iron oxide, iron ore powder or other iron oxides, or a melting agent as an auxiliary agent for desulfurization, such as calcium fluoride, magnesium fluoride, lithium fluoride or sodium fluoride.

The following Examples are given to illustrate the present invention in greater detail. Unless otherwise indicated, all parts, percents, ratios and the like are by weight.

EXAMPLE 1

A powdery mixture of 50% by weight of a ferromanganese collected dust (comprising 15% $Na_2O$, 48% $K_2O$, 4% CaO, 10% $SiO_2$, 3% $Al_2O_3$, 15% MnO and the remainder being C and F) and 50% by weight of a ferrochromium collected dust (comprising 10% $Na_2O$, 40% $K_2O$, 8% CaO, 20% $SiO_2$, 4% $Al_2O_3$, 8% C, 4% $Cr_2O_3$, and the remainder being $Fe_2O_3$ and F) was blown from lances into molten iron (with an S content of 0.051%) placed in a ladle, using nitrogen gas. The amount of the powdery mixture was 4 Kg per ton of the molten iron. The S content of the molten iron after this desulfurization was 0.015%, and thus, the rate of desulfurization was 70.4%.

EXAMPLE 2

A powdery mixture of 40% by weight of a ferromanganese collected dust (comprising 5% $Na_2O$, 23% $K_2O$, 15% $SiO_2$, 2% $Al_2O_3$, 3% $Fe_2O_3$, 18% MnO, 5% CaO, 6% C and the remainder being $CO_2$ and F) and 60% by weight of soda ash was blown into molten iron (with an S content of 0.046%) in a ladle together with nitrogen gas using the same apparatus as used in Example 1. The amount of the powdery mixture was 4 Kg per ton of the molten iron. The S content of the molten iron after desulfurization was 0.013%, and thus, the rate of desulfurization was 71.7%.

EXAMPLE 3

A mixture of 87% of the dust mixture used in Example 1, 6% by weight of Portland cement and 7% by weight of water was compressed with a granulator to form granules each with a size of 25 mm × 25 mm × 15 mm. This desulfurizing agent was placed in a ladle in an amount of 5 Kg per ton of molten iron, and the molten iron was poured into the ladle. As a result, the S content of the molten iron decreased from the original 0.055% to 0.028% after desulfurization, and thus, the rate of desulfurization was 49.1%.

EXAMPLE 4

A mixture of 25% by weight of the ferrochromium dust used in Example 2, 55% by weight of soda ash, 10% by weight of Portland cement and 10% by weight of water was granulated to the same size as in Example 3 using the same procedure as in Example 3. The resulting desulfurizing agent was placed in a ladle in an amount of 5 Kg per ton of molten iron, and the molten iron was poured into the ladle to desulfurize the iron. The S content of the molten iron decreased from the original 0.051% to 0.025% after desulfurization. The rate of desulfurization was 51.8%.

For comparison, soda ash was blown together with nitrogen gas into molten iron in an amount of 4 Kg per ton of the molten iron. As a result, the S content of the molten iron decreased from the original 0.049 to 0.023% after desulfurization, and thus, the rate of desulfurization was 52.2%.

As a further comparison, 5 Kg of molded soda ash was placed in a ladle per ton of molten iron, and then, the molten iron was poured into the ladle to desulfurize the iron. The S content of the molten iron decreased from the original 0.048 to 0.029% after desulfurization, and thus, the rate of desulfurization was 38.5%.

While the invention has been described in detail and with reference to specific embodiments thereof, it will be apparent to one skilled in the art that various changes and modifications can be made therein without departing from the spirit and scope thereof.

What is claimed is:

1. In a method for desulfurizing molten iron, which comprises adding a desulfurizing agent to the molten iron, the improvement which comprises said desulfurizing agent being at least one of:

a. a dust collected from the smelting step of manganese which comprises by weight, about 2 to 20% of $Na_2O$, about 5 to 50 % of $K_2O$, about 20 to 40 % of MnO, about 5 to 30% of CaO, about 3 to 20 % of $SiO_2$ about 3 to 10 % of C, and not more than about 5 % of each of $Al_2O_3$ $Fe_2O_3$, and $CaF_2$; and b. a dust collected from the smelting step of chromium which comprises, by weight, about 3 to 25 % of $Na_2O$, about 4 to 40% of $K_2O$, about 4 to 15% of CaO, about 5 to 30 % of $SiO_2$, not more than about 5% of $Cr_2O_3$ and not more than about 5% of each of C, $Al_2O_3$, $Fe_2O_3$, and $CaF_2$.

2. The method for desulfurizing molten iron of claim 1, wherein said desulfurizing agent is a mixture comprising about 5 to 99% by weight of said at least one dust (a) collected from the smelting step of manganese and dust (b) collected from the smelting step of chromium and about 1 to 95 % by weight of soda ash.

3. The method for desulfurizing molten iron of Claim 1, wherein said desulfurizing agent is a mixture comprising about 45 to 85 % of said at least one dust (a) collected from the smelting step of manganese and dust (b) collected from the smelting step of chromium, about 2 to 25 % by weight of a cement and about 3 to 30% by weight of water.

4. The method for desulfurizing molten iron of Claim 1, wherein said desulfurizing agent is a mixture comprising about 5 to 94% by weight of said at least one dust (a) collected from the smelting step of manganese and dust (b) collected from the smelting step of chromium, about 1 to 40% by weight of soda ash, about 2 to 25% by weight of a cement and about 3 to 30% by weight of water.

5. The method for desulfurizing molten iron of claim 1 wherein said at least one of (a) and (b) has a $$\frac{Na_2O(\%) + K_2O(\%)}{SiO_2(\%) + Al_2O_3(\%)}$$

value of at least about 2.0 and if said value is not at least about 2.0. said dust is used in admixture with soda ash.

6. The method for desulfurizing molten iron of claim 1, wherein the preplaced method is used.

7. The method for desulfurizing molten iron of claim 1, wherein the agitation method is used.

8. The method for desulfurizing molten iron of claim 1, wherein the blowing method is used.

9. The method for desulfurizing molten iron of claim 1, wherein said desulfurizing agent further contains a bulking agent selected from the group consisting of scale, red iron oxide, iron ore powder and other iron oxides.

10. The method for desulfurizing molten iron of claim 1, wherein said desulfurizing agent further contains a melting agent selected from the group consisting of calcium fluoride, magnesium fluoride, lithium fluoride and sodium fluoride.

* * * * *